US008753067B2

(12) United States Patent
Shindo

(10) Patent No.: US 8,753,067 B2
(45) Date of Patent: Jun. 17, 2014

(54) STEAM VALVE APPARATUS

(75) Inventor: Osamu Shindo, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 173 days.

(21) Appl. No.: 13/273,348

(22) Filed: Oct. 14, 2011

(65) Prior Publication Data

US 2012/0091373 A1 Apr. 19, 2012

(30) Foreign Application Priority Data

Oct. 14, 2010 (JP) ..... P2010-231582

(51) Int. Cl.
*F01B 25/06* (2006.01)

(52) U.S. Cl.
USPC ..... 415/30; 415/118; 415/43; 60/399

(58) Field of Classification Search
USPC ..... 415/30, 118, 43; 91/445, 457; 60/399
See application file for complete search history.

(56) References Cited

U.S. PATENT DOCUMENTS 2,253,112 A * 8/1941 De Boysson ..... 60/399
4,015,430 A * 4/1977 Braytenbah et al. ..... 376/211
4,343,454 A * 8/1982 Kure-Jensen et al. ..... 251/26
4,695,221 A * 9/1987 Swearingen ..... 415/36
5,292,225 A * 3/1994 Dyer ..... 415/29
5,295,783 A 3/1994 Lesko et al.
6,964,162 B2 * 11/2005 Takahashi et al. ..... 60/453
7,234,678 B1 6/2007 Shindo et al.
7,322,788 B2 1/2008 Shindo et al.

FOREIGN PATENT DOCUMENTS

EP 1 522 681 A2 4/2005
EP 1 522 681 A3 4/2005
JP 2000-64811 2/2000
JP 2005-240739 9/2005
JP 2005-307865 11/2005

OTHER PUBLICATIONS

European Search Report issued by the European Patent Office on Apr. 4, 2012, for European Patent Application No. 11185203.4.

* cited by examiner

*Primary Examiner* — John K Fristoe, Jr.
*Assistant Examiner* — Umashankar Venkatesan
(74) *Attorney, Agent, or Firm* — Finnegan, Henderson, Farabow, Garrett & Dunner, L.L.P.

(57) ABSTRACT

In one embodiment, a steam valve apparatus includes: a hydraulic cylinder including an internal space sectioned into first and second chambers by a piston operated by a hydraulic liquid; a first passage to supply the hydraulic liquid to the first chamber; a second passage connecting the first and second chambers; a third passage to drain the hydraulic liquid from the second chamber; an electromagnetic valve switched between first and second states; a first cartridge valve opening the first passage when the electromagnetic valve is in the first state and closing the first passage when the electromagnetic valve is in the second state; and a second cartridge valve closing the first passage when the electromagnetic valve is in the first state and opening the first passage when the electromagnetic valve is in the second state.

16 Claims, 5 Drawing Sheets

STEAM VALVE APPARATUS

CROSS-REFERENCE TO RELATED APPLICATION

This application is based upon and claims the benefit of priority from Japanese Patent Application No. 2010-231582, filed on Oct. 14, 2010; the entire contents of which are incorporated herein by reference.

FIELD

Embodiments described herein relate generally to a steam valve apparatus installed in a steam system of a turbo machine such as a steam turbine in a power plant.

BACKGROUND

In a power generation facility and the like that uses a turbo machine such as a steam turbine, various protection apparatuses for detecting phenomena such as an abnormal rise of an rpm (rotation speed), an extension difference, an oscillation enlargement, a high temperature in a low-pressure evacuation (exhaust) chamber, lowering of a bearing hydraulic pressure, lowering of a discharge pressure of a main oil pump, and a failure of a boiler/power generator and preventing accidents from occurring or minimalizing damages due to the accidents are provided.

For example, a hydraulic system of a steam valve apparatus as follows is disclosed. Specifically, in addition to a case where an rpm of a normally-driven steam turbine is increased to a set rpm or more, an anomaly (abnormality) of the steam turbine is detected at an anomaly (abnormality) detection portion of a protection apparatus. The anomaly detection portion generates an electric signal, and a main steam stop valve set at a steam inlet of the steam turbine is closed based on the signal so that a steam influx to the steam turbine is blocked.

Hereinafter, the structure of the power generation facility of the related art will be described with reference to FIG. 3.

It should be noted that the steam valve apparatus described below is a collective term for, for example, a main steam stop valve, a governor valve, a reheat steam stop valve, and an intercept valve that are set in the steam turbine.

In FIG. 3, a steam discharged from a boiler 100 passes through a main steam stop valve 101 and a governor valve 102 and enters a high-pressure turbine (HT) 103. After an expansion work in the high-pressure turbine (HT) 103, the steam returns to the boiler 100 via a check valve 104.

After that, the steam heated by a reheater (RH) enters a medium-pressure turbine (MT) 107 via a reheat steam stop valve 105 and an intercept valve 106. The steam undergoes an expansion work in the medium-pressure turbine (MT) 107 and enters a low-pressure turbine (LT) 108 to additionally undergo an expansion work. The steam that has undergone the expansion work in the low-pressure turbine (LT) 108 is changed into water in a condenser 109 and supplied to the boiler 100 again after being pressure-raised in a feed pump (FP) 110 (steam circulation). The high-pressure turbine (HT) 103, the medium-pressure turbine (MT) 107, and the low-pressure turbine (LT) 108 are coupled to the same axis as a power generator (not shown) to drive it.

The plant shown in FIG. 3 is structured as follows to raise an operation efficiency of the plant. Specifically, a high-pressure turbine bypass valve 111 is set between an upstream side of the main steam stop valve 101 and an inlet side of the reheater (RH) of the boiler 100, and a low-pressure turbine bypass valve 112 is set between an outlet side of the reheater (RH) and the condenser 109. As a result, irrespective of whether the turbine is driven or not, circulation drive of a boiler system alone can be performed.

It should be noted that FIG. 3 shows an example of a typical steam turbine power generation facility. It is also possible to use a uniaxial or multi-axial combined cycle power plant by combining a gas turbine (not shown) with the steam turbine power generation facility and replacing the boiler 100 with an exhaust heat recovery boiler.

The power generation facility shown in FIG. 3 includes various protection apparatuses for preventing accidents from occurring in the power generation facility or minimalizing, in case of accidents, damages due to the accidents. The protection apparatuses detect phenomena such as an abnormal rise of a turbine rpm (rotation speed), an increase in an expansion of a turbine shaft length, an oscillation enlargement, a temperature rise in a low-pressure evacuation chamber, lowering of a bearing hydraulic pressure, lowering of a discharge pressure of a main oil pump, and a failure of a boiler/power generator.

For example, in a case where an rpm of a normally-driven turbine is increased to a set rpm or more and a case where other turbine anomalies occur, an anomaly (abnormality) detection portion detects the anomaly and outputs an electric anomaly (abnormality) signal. The anomaly signal is transmitted to high-speed operation electromagnetic valves 21 and 22 set in a hydraulic drive apparatus 20 of a main steam stop valve 200 shown in FIG. 4, for example.

Hereinafter, the structure of the hydraulic drive apparatus 20 of the main steam stop valve 200 will be described with reference to FIG. 4. FIG. 4 shows a structure of a hydraulic drive system of the main steam stop valve that blocks energy from entering the steam turbine as an example of the main steam stop valve 200.

In FIG. 4, the steam valve (steam valve apparatus) 200 includes a main valve 201, a piston 202, a hydraulic cylinder 203, a lower cylinder 204, an upper cylinder 205, and a hydraulic system 206. The hydraulic cylinder 203 is a double-action type and the inside thereof is sectioned into the lower cylinder (valve-open-side chamber (first chamber)) 204 and the upper cylinder (valve-close-side chamber (second chamber)) 205 by the piston 202. The hydraulic cylinder 203 includes, on both the valve-open side and the valve-close side, inlet and outlet ports for a hydraulic oil (hydraulic liquid). The hydraulic system 206 is equipped with a hydraulic pipe (also called oil passage (or passage)) and various valves and connects the lower cylinder 204 and the upper cylinder 205 to a hydraulic pressure generator and an oil tank (not shown). It should be noted that the piston 202, the hydraulic cylinder 203, and the hydraulic system 206 constitute the hydraulic drive apparatus 20 of the steam valve 200.

In the main steam stop valve 200, a valve position can be controlled using a servo valve 25 to be described later. As the main steam stop valve 200, a valve in which a sub valve is incorporated for controlling a steam flow amount at the time of activation and the like can be used.

A steam pressure acts on an upstream side of the main valve 201 of the main steam stop valve 200. Due to the hydraulic oil accumulated in the lower cylinder 204 located at a lower portion of the hydraulic cylinder 203 that accommodates the piston 202 coupled to the main valve 201, a hydraulic pressure acts on the lower portion of the piston 202. As a result, the main valve 201 is opened over the steam pressure.

On the other hand, when an anomaly (abnormality) occurs in the steam turbine, the main valve 201 is closed by discharging the oil accumulated in the lower cylinder 204 of the piston 202.

In FIG. 4, the hydraulic oil 26 is supplied from the hydraulic pressure generator (not shown). The hydraulic oil 26 is first split into two hydraulic pipes pl1 and pl2 at an inlet-side branch point J1 of the hydraulic system 206 surrounded by dashed lines. The hydraulic pipe pl1 is connected to a first oil filter 27, and the hydraulic pipe pl2 is connected to a second oil filter (oil filter dedicated to servo valve) 28. The hydraulic oil that has entered the first oil filter 27 from the hydraulic pipe pl1 is additionally split into two hydraulic pipes pl3 and pl4 at an outlet-side branch point J2 of the first oil filter 27.

The hydraulic pipe pl3 as one of the pipes is connected to a P port of the servo valve 25 responsible for a steam flow amount control function of the steam valve 200. The servo valve 25 accommodates a movable spool (reel-type shaft) inside a sleeve (tube) having inlet and outlet ports. By receiving a valve position control signal transmitted from a turbine control apparatus (not shown) by a coil 25C, the spool position is controlled. A pilot oil of the servo valve 25 is supplied via the second oil filter 28.

The valve position control signal from the turbine control apparatus (not shown) is input to the coil 25C. Based on the valve position control signal, the hydraulic oil 26 supplied to the P port from the hydraulic pipe pl3 reaches a branch point J3 via a B port.

The hydraulic oil 26 is supplied from the branch point J3 to the lower cylinder 204 of the piston 202 via a hydraulic pipe pl9. At the same time, the hydraulic oil 26 is also supplied to A ports of cartridge valves 29 and 30 via a hydraulic pipe pl10. The piston 202 of the main steam stop valve 200 operates to be opened and closed by the hydraulic oil 26 that has passed the servo valve 25.

On the other hand, the hydraulic pipe pl4 as the other one of the pipes split at the branch point J2 described above is additionally split into two hydraulic pipes pl5 and pl6 at a branch point J4. The hydraulic pipe pl5 is connected to a P port of the high-speed operation electromagnetic valve 21, and the hydraulic pipe pl6 is connected to a P port of the high-speed operation electromagnetic valve 22. The high-speed operation electromagnetic valves 21 and 22 are structured as a "3-port 2-position single-action electromagnetic valve" that includes a sleeve, 3 inlet and outlet ports provided in the sleeve, and a spool that is movably accommodated in the sleeve.

The high-speed operation electromagnetic valves 21 and 22 are important apparatuses for blocking the steam (steam energy) that enters the steam turbine when any anomaly (abnormality) occurs in the steam turbine. Therefore, the high-speed operation electromagnetic valves 21 and 22 constantly maintain an excitation state when the steam turbine is driven normally and are put to a non-excitation state at the time an anomaly (abnormality) occurs. Further, an anomaly (abnormality) signal to the high-speed operation electromagnetic valve 21 is applied to duplexed excitation coils 23*a* and 23*b* from a sequence circuit (not shown). Similarly, an anomaly signal to the high-speed operation electromagnetic valve 22 is applied to duplexed excitation coils 24*a* and 24*b* from a sequence circuit (not shown).

As described above, during normal drive of the steam turbine, the excitation coils 23*a*, 23*b*, 24*a*, and 24*b* of the high-speed operation electromagnetic valves 21 and 22 are constantly in an excitation state. Therefore, the hydraulic oil 26 passes the high-speed operation electromagnetic valves 21 and 22 from the P port to the A port. After that, the hydraulic oil 26 is supplied to the secondary side of the cartridge valves 29 and 30 attached to the high-speed operation electromagnetic valves 21 and 22, respectively, via hydraulic pipes pl13 and pl14. It should be noted that the B ports of the cartridge valves 29 and 30 are connected to the port of the upper cylinder 205 of the hydraulic drive apparatus 20 and also connected to the T port of the servo valve 25 via the hydraulic pipe pl7.

The hydraulic oil 26 that has passed through the servo valve 25 and been supplied to the A ports on the primary side of the cartridge valves 29 and 30 and the hydraulic oil 26 that has passed the P and A ports of the high-speed operation electromagnetic valves 21 and 22 from the hydraulic pipes pl5 and pl6 and been supplied to the secondary side of the cartridge valves 29 and 30 simultaneously act on the valving elements 31 and 32 of the cartridge valves 29 and 30. Therefore, forces that act on both sides of the valving elements 31 and 32 are balanced. As a result, the valving elements 31 and 32 of the cartridge valves 29 and 30 do not move.

Here, assuming that the anomaly detection portion of the protection apparatus of the steam turbine (not shown) has detected an anomaly, an anomaly signal is output from the anomaly detection portion and electrically transmitted to the coils 23*a*, 23*b*, 24*a*, and 24*b* of the high-speed operation electromagnetic valves 21 and 22 provided in the hydraulic drive apparatus 20 of the steam valve 200 shown in FIG. 4 via a sequence circuit (not shown).

When input with the anomaly signal, the coils 23*a*, 23*b*, 24*a*, and 24*b* of the high-speed operation electromagnetic valves 21 and 22 invert to a non-excitation state from the previous constant excitation state. By the inversion of the high-speed operation electromagnetic valves 21 and 22, the passage of the hydraulic oil 26 is switched. Before the switch, the hydraulic oil 26 passes the high-speed operation electromagnetic valves 21 and 22 from the P port to the A port and is supplied to the secondary side of the cartridge valves 29 and 30 via the hydraulic pipes pl13 and pl14. After the switch, the hydraulic oil 26 is discharged to an oil tank (not shown) via the hydraulic pipe pl8 and an oil-drain port 33.

Therefore, the valving elements 31 and 32 are pushed back by a hydraulic force of the hydraulic oil 26 supplied to the primary side from the hydraulic pipe pl10 via the servo valve 25 in the cartridge valves 29 and 30, and the A ports are opened. As a result, the hydraulic oil 26 accumulated in the lower cylinder 204 of the piston 202 reaches the A ports of the cartridge valves 29 and 30 via the hydraulic pipes pl9 and pl10 and discharged from the B ports of the cartridge valves 29 and 30. Consequently, the steam valve 200 closes.

At this time, the B ports of the cartridge valves 29 and 30 are connected to the port of the upper cylinder 205 located at an upper portion of the piston 202 of the hydraulic drive apparatus 20 by the hydraulic pipe pl7. Therefore, the hydraulic oil from the B ports of the cartridge valves 29 and 30 enters the upper cylinder 205. The hydraulic oil 26 that has entered the upper cylinder 205 is discharged to the oil tank (not shown) from the upper cylinder 205 of the piston 202 via the hydraulic pipe pl8 and the oil-drain port 33.

As described above, the hydraulic oil 26 accumulated in the lower cylinder 204 of the piston 202 in the hydraulic cylinder 203 temporarily enters the upper cylinder 205 of the piston 202. As a result, an action to press down the piston 202 occurs. In addition, since the upper cylinder 205 acts as an oil tank, the steam valve 200 can be more-rapidly and positively closed.

It should be noted that since reset springs 34 and 35 of the valving elements 31 and 32 are incorporated on the secondary side of the cartridge valves 29 and 30, if the hydraulic pressure of the A ports of the cartridge valves 29 and 30 is eliminated, the valving elements 31 and 32 of the cartridge valves 29 and 30 automatically return to a fully-closed state so as to block the A ports by the forces of the reset springs 34 and 35.

The hydraulic drive apparatus 20 of the steam valve 200 shown in FIG. 4 includes the servo valve 25 and controls the valve position of the main valve 201. It should be noted that the main valve may be simply turned ON and OFF depending on the purpose of the steam valve.

FIG. 5 is a structural diagram of a drive apparatus 40 of a steam valve 300 of the related art having the ON/OFF function. It should be noted that in FIG. 5, components having the same functions as those of FIG. 4 are denoted by the same symbols, and overlapping descriptions will be omitted as appropriate.

In FIG. 5, the steam valve 300 includes a main valve 301, a piston 302, a hydraulic cylinder 303, a lower cylinder 304, an upper cylinder 305, and a hydraulic system 306. The hydraulic cylinder 303 is a double-action type and the inside thereof is sectioned into the lower cylinder (valve-open-side chamber) 304 and the upper cylinder (valve-close-side chamber) 305 by the piston 302. The hydraulic cylinder 303 includes, on both the valve-open side and the valve-close side, inlet and outlet ports for a hydraulic oil. The hydraulic system 306 is equipped with a hydraulic pipe (also called oil passage (or passage)) and various valves and connects the lower cylinder 304 and the upper cylinder 305 to a hydraulic pressure generator and an oil tank (not shown). It should be noted that the piston 302, the hydraulic cylinder 303, and the hydraulic system 306 constitute the hydraulic drive apparatus 40 of the steam valve 300.

Points of the hydraulic system 306 shown in FIG. 5 different from those of the hydraulic system 206 shown in FIG. 4 are as follows. Specifically, the second oil filter 28 adopted in FIG. 4 is removed, and the servo valve 25 is replaced with a test electromagnetic valve 36 (also called third electromagnetic valve). The test electromagnetic valve 36 is operated in a non-excitation state (i.e., constant non-excitation state) during normal drive.

As in the servo valve 25, in the test electromagnetic valve 36, a position of a spool movably accommodated in a sleeve having inlet/outlet ports is controlled by a coil. At a time a valve test is carried out for preventing an adhesion of a valve shaft of the steam valve 300 from occurring during normal drive, a simulation signal is transmitted from a test apparatus (not shown) to a coil 36C of the test electromagnetic valve 36. Based on the simulation signal, the coil 36C is excited, and the port is switched. By being connected to the hydraulic pipe pl7 via the A port of the test electromagnetic valve 36, the hydraulic pipe pl9 is connected to the port of the upper cylinder 305.

Accordingly, the oil in the lower cylinder 304 of the piston 302 is gradually discharged from the oil-drain port 33 via the hydraulic pipes pl9 and pl7, the upper cylinder 305, and the hydraulic pipe pl8. As a result, the main valve 301 of the steam valve 300 is closed. After the main valve 301 of the steam valve 300 is fully closed, the test electromagnetic valve 36 is inverted to a non-excitation state from an excitation state. Consequently, the main valve 301 gradually opens, and the valve test ends.

If inadequate components in the hydraulic drive apparatus can be replaced with adequate components without stopping the steam turbine in normal drive, damages that occur can be minimalized.

As described above, the hydraulic pipes of the steam valve apparatus used in the steam turbine is a highly-reliable hydraulic system. However, the steam valve apparatus of the related art may not operate normally when a feature failure or operation failure occurs in the servo valve or the test electromagnetic valve during normal drive, for example.

A high-pressure hydraulic oil is constantly supplied to the hydraulic pipes of the steam valve apparatus of the related art. Therefore, the hydraulic oil scatters when a part of the hydraulic pipes is opened to replace inadequate components with adequate components. For the reason described above, it has been difficult to remove inadequate components and replace them with adequate components during normal drive of the steam turbine in the hydraulic pipes of the steam valve apparatus of the related art.

In this embodiment, inadequate components can be removed and replaced with adequate components during normal drive of a turbo machine such as the steam turbine. As a result, a maintenance property of the steam valve apparatus is improved.

DETAILED DESCRIPTION

In one embodiment, a steam valve apparatus includes: a steam valve apparatus includes: a steam valve passing or blocking a steam to a turbo machine; a piston operated by a hydraulic liquid to open or close the steam valve; a hydraulic cylinder including an internal space sectioned into a first chamber and a second chamber by the piston, the first chamber being on a close side of the steam valve, and the second chamber being on an open side of the steam valve; a first passage to supply the hydraulic liquid to the first chamber; a second passage connecting the first chamber and the second chamber; a third passage to drain the hydraulic liquid from the second chamber; an electromagnetic valve switched between a first state and a second state based on an input of a signal; a first cartridge valve opening the first passage when the electromagnetic valve is in the first state and closing the first passage when the electromagnetic valve is in the second state; and a second cartridge valve closing the first passage when the electromagnetic valve is in the first state and opening the first passage when the electromagnetic valve is in the second state.

Figure 4:
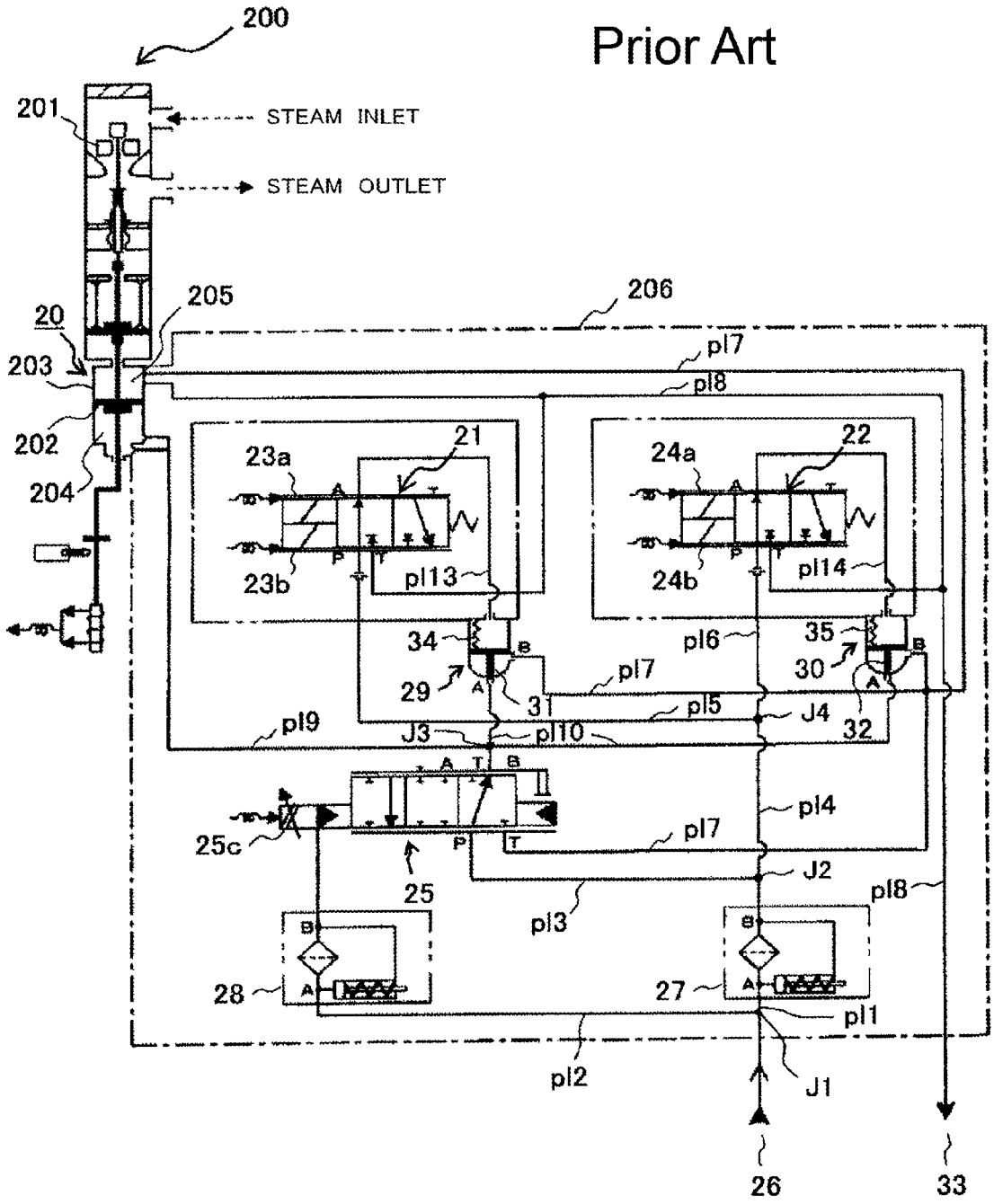
FIG. 4 is a structural diagram of a hydraulic drive apparatus of a steam valve of the related art.

Hereinafter, embodiments will be described with reference to the drawings. It should be noted that structural components that are the same as those of FIGS. 4 and 5 described above are denoted by the same symbols, and descriptions thereof will be omitted. Different points will be mainly described.

First Embodiment

Figure 1:
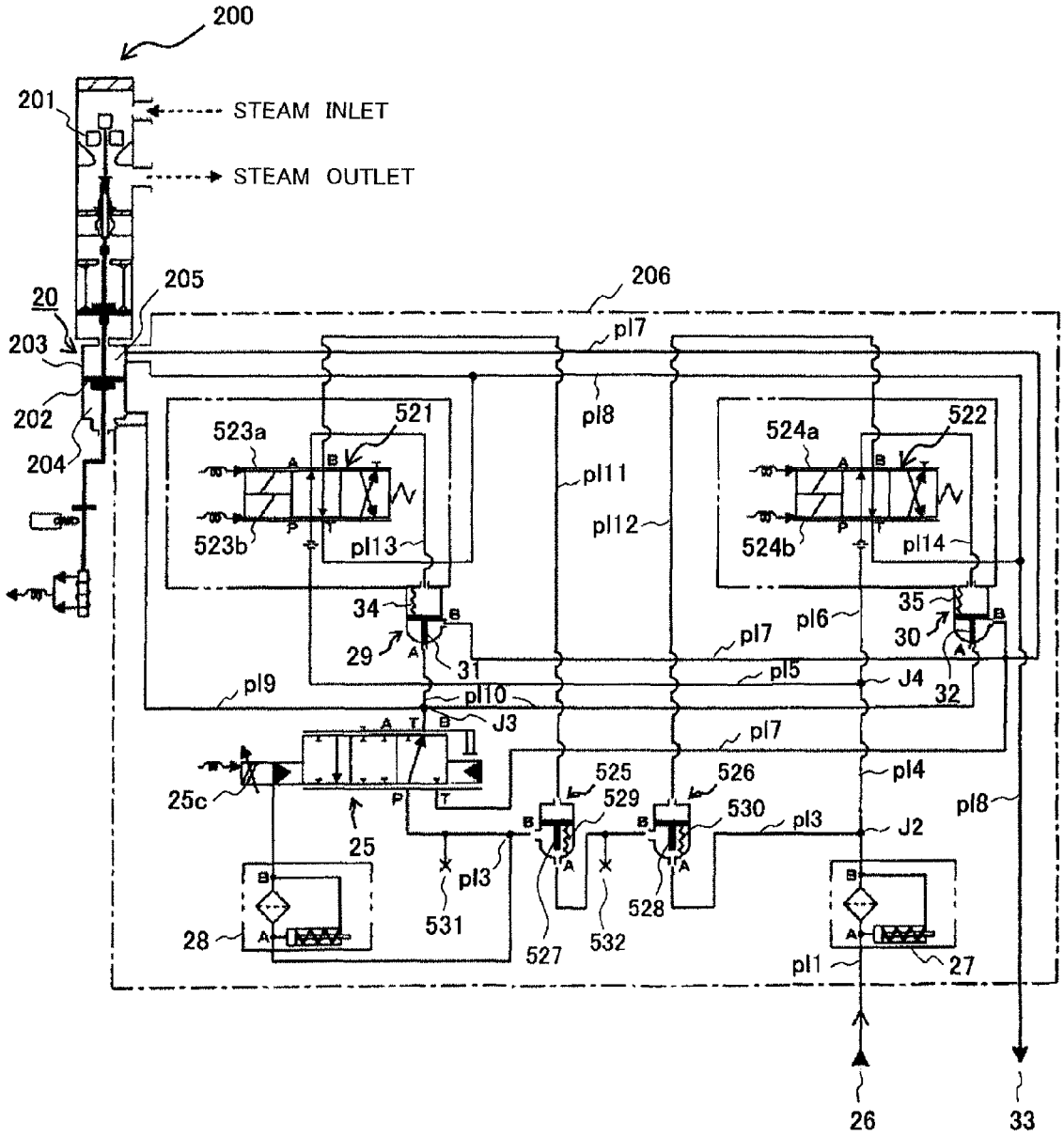
FIG. 1 is a structural diagram of a hydraulic drive apparatus of a steam valve according to a first embodiment.

FIG. 1 is a structural diagram of a drive apparatus of a steam valve according to a first embodiment. The first embodiment is an embodiment for solving the problem of the related art shown in FIG. 4. The following points of FIG. 1 are different from those of FIG. 4.

The first point is as follows. In the case of the related art shown in FIG. 4, the high-speed operation electromagnetic valves 21 and 22 have been structured as a "3-port 2-position single-action electromagnetic valve". In contrast, high-speed operation electromagnetic valves (also called first and second electromagnetic valves) 521 and 522 of the first embodiment are structured as a "4-port 2-position single-action electromagnetic valve". Accompanying this, ends of hydraulic pipes pl11 and pl12 are connected to an output B port side of the high-speed operation electromagnetic valves 521 and 522.

The second point is as follows. Cartridge valves (also called first and third cartridge valves) 525 and 526 are newly provided on an input port side of the servo valve 25. Output port sides of the cartridge valves 525 and 526 are connected to the other ends of the hydraulic pipes pl11 and pl12 so as to come into communication with the B port side of the high-speed operation electromagnetic valves 521 and 522.

Hereinafter, with reference to FIG. 1, the structure of the hydraulic system 206 will first be described in detail regarding the first embodiment.

In FIG. 1, the hydraulic pipe pl1 connected to a hydraulic pressure generator (not shown) is connected to the first oil filter 27 provided on the inlet side of the hydraulic system 206 surrounded by dashed lines. The hydraulic pipe pl1 is split into two hydraulic pipes pl3 and pl4 at the branch point J2 on the outlet side of the first oil filter 27. Of the two hydraulic pipes, the hydraulic pipe pl3 functions as an oil fill tube that connects the branch point J2 and the P port of the servo valve 25. At an intermediate portion of the hydraulic pipe pl3, the two cartridge valves 525 and 526 are cascaded (connected in series).

Specifically, of the two cartridge valves, the A port of the cartridge valve 526 is connected to the branch point J2 by the hydraulic pipe pl3. The B port of the cartridge valve 526 is connected to the A port of the cartridge valve 525. Further, the B port of the cartridge valve 525 is connected to the P port of the servo valve 25 by the hydraulic pipe pl3.

The cartridge valves 526 and 525 are each sectioned into a primary side (input/output port side) and a secondary side (control port side) by valving elements 528 and 527. Reset springs (elastic bodies) 530 and 529 of the valving elements 528 and 527 are incorporated on the primary side of the cartridge valves 526 and 525, respectively. When a hydraulic pressure on the secondary side (control port side) of the cartridge valves 525 and 526 disappears, the reset springs 529 and 530 automatically restore the valving elements 527 and 528 by their restoring forces. As a result, the A ports of the cartridge valves 525 and 526 are fully opened. Here, desirably, valve sheets of the valving elements 527 and 528 are a poppet-shaped metal touch that totally prevents leakage and of a tight-shut type having a function to totally stop the flow of fluid.

The pilot oil of the servo valve 25 is split at a branch point on a downstream side of the B port of the cartridge valve 525 and supplied via the second oil filter 28. Since the second oil filter 28 is serially arranged with the first oil filter 27, it may be omitted. Pressure detection taps 531 and 532 are provided on the downstream side of the B ports of the cartridge valves 525 and 526, respectively. By connecting a pressure sensor to the pressure detection taps 531 and 532, a pressure of the hydraulic oil 26 can be measured.

Incidentally, the hydraulic pipe connected to the B port of the servo valve 25 is split into the hydraulic pipes pl9 and pl10 at the branch point J3. The hydraulic pipe pl9 as one of the pipes is connected to the lower cylinder 204 of the hydraulic cylinder 203. The hydraulic pipe pl10 as the other pipe is connected to the A ports of the cartridge valves (also called second and fourth cartridge valves) 29 and 30.

Insides of the cartridge valves 29 and 30 are sectioned into the primary side and the secondary side by the valving elements 31 and 32, respectively. The reset springs (elastic bodies) 34 and 35 of the valving elements are incorporated on the secondary side. The B ports of the cartridge valves 29 and 30 are connected to the T port of the servo valve 25 by the hydraulic pipe pl7.

On the other hand, the hydraulic pipe pl4 as the other one of the pipes split at the branch point J2 is further split into the hydraulic pipes pl5 and pl6 at the branch point J4. Of those, the hydraulic pipe pl5 is connected to the P port of the high-speed operation electromagnetic valve 521 via an orifice. The hydraulic pipe pl6 as the other pipe is connected to the P port of the high-speed operation electromagnetic valve 522 via an orifice.

It should be noted that the high-speed operation electromagnetic valves 521 and 522 are structured as a "4-port 2-position single-action electromagnetic valve" and include duplexed excitation coils 523*a*, 523*b*, 524*a*, and 524*b*.

The excitation coils 523*a*, 523*b*, 524*a*, and 524*b* are constantly excited during normal drive of the steam turbine and maintain the spools inside the sleeves at positions shown in the figure (referred to as first position). As a result, the P port (first port) and A port (fourth port) out of the 4 inlet and outlet ports provided in the sleeve are in communication with each other, and the B port (third port) and T port (second port) are also in communication with each other. When the excitation coils 523*a*, 523*b*, 524*a*, and 524*b* are put to a non-excitation state from the excitation state, the high-speed operation electromagnetic valves 521 and 522 move the spools from the first position to a different position (second position) in the sleeves by the restoring forces of the springs. As a result, the P and B ports are in communication with each other, and the A and T ports are also in communication with each other. The term "communication" used herein refers to a state where the inlet and outlet ports (refers to P, A, B, and T ports) provided in the sleeves are in communication with one another by a passage formed in the spool to thus form an oil passage, that is, a state where the hydraulic oil 26 flows.

In the constant excitation state shown in FIG. 1, the A, B, and T ports of the high-speed operation electromagnetic valves 521 and 522 are connected as follows. The A ports are connected to the secondary side of the cartridge valves 29 and 30 via the hydraulic pipes pl13 and pl14. The B ports are connected to the secondary side of the cartridge valves 525 and 526 via the hydraulic pipes pl11 and pl12. The T ports are connected to the upper cylinder 205 by the hydraulic pipe pl8 and thus connected to the oil-drain port 33.

Next, an operation of the steam valve apparatus according to the first embodiment will be described.

During normal drive of the steam turbine, the valves of the hydraulic system 206 shown in FIG. 1 are opened and closed as follows. Specifically, a hydraulic pressure caused by the hydraulic oil 26 acts on the lower cylinder 204 of the hydraulic cylinder 203. On the other hand, since an oil tank (not shown) is connected to the upper cylinder 205 from the oil-drain port 33, a hydraulic pressure does not act on the upper cylinder 205. Therefore, the main valve 201 opens so that the main steams flow. The high-speed operation electromagnetic valves 521 and 522 are maintained in the constant excitation state. Therefore, the hydraulic oil 26 filtered by the first oil filter 27 is supplied to the P ports of the high-speed operation electromagnetic valves 521 and 522 via the hydraulic pipes pl5 and pl6. After that, the hydraulic oil 26 flows from the P ports to the A ports and is supplied to the secondary side of the cartridge valves 29 and 30 via the hydraulic pipes pl13 and pl14, respectively.

At this time, the T ports of the high-speed operation electromagnetic valves 521 and 522 are connected to an oil tank (not shown) from the oil-drain port 33. Therefore, since a hydraulic pressure is not applied to the T ports, the A ports of the cartridge valves 525 and 526 are opened by the restoring forces of the reset springs 529 and 530.

Therefore, the hydraulic oil 26 filtered by the first oil filter 27 sequentially passes the cartridge valves 526 and 525 to be supplied to the P port of the servo valve 25. The hydraulic oil 26 is also supplied to the primary side (A ports) of the cartridge valves 29 and 30 via the hydraulic pipe pl10 from the B port of the servo valve 25.

The hydraulic oil 26 supplied to the primary side (A ports) of the cartridge valves 29 and 30 and the hydraulic oil 26 supplied to the secondary side thereof simultaneously act on both sides of the valving elements 31 and 32 and are balanced. Therefore, the valving elements 31 and 32 themselves do not move. As a result, the A ports of the cartridge valves 29 and 30 maintain the constantly-closed state.

A case where the anomaly (abnormality) detection portion of the protection apparatus detects an anomaly (abnormality) during normal drive of the steam turbine described above will be discussed.

When an anomaly occurs in the steam turbine, the anomaly detection portion in the protection apparatus (not shown) detects the anomaly and outputs an electric anomaly signal. The electric anomaly signal is transmitted to the coils 523*a*, 523*b*, 524*a*, and 524*b* of the high-speed operation electromagnetic valves 521 and 522 in the hydraulic system 206 shown in FIG. 1 via a sequence circuit apparatus (not shown).

Upon receiving the electric anomaly signal, the high-speed operation electromagnetic valves 521 and 522 in the constant excitation state are put to a non-excitation state. Therefore, the spools are moved from the first position to the second position by the restoring forces of the springs. As a result, the hydraulic oil 26 that has passed the P and A ports to be supplied to the secondary side of the cartridge valves 29 and 30 in the constant excitation state is blocked. This is the operation of the high-speed operation electromagnetic valves 521 and 522.

When the high-speed operation electromagnetic valves 521 and 522 are operated, forces acting on the valving elements 31 and 32 of the cartridge valves 29 and 30 are unbalanced. Therefore, the valving elements 31 and 32 move upwardly from the state shown in the figure to open the A ports. As a result, the hydraulic pipes pl10 and pl7 come into communication with each other via the A and B ports of the cartridge valves 29 and 30.

After that, the hydraulic oil 26 accumulated in the lower cylinder 204 maintained at the same oil pressure as the A ports of the cartridge valves 29 and 30 passes the hydraulic pipes pl9 and pl10 and the A and B ports of the cartridge valves 29 and 30 to be discharged to the hydraulic pipe pl7 side. Further, the hydraulic oil 26 enters the upper cylinder 205 from the hydraulic pipe pl7 and is discharged to an oil tank (not shown) from the oil-drain port 33 via the hydraulic pipe pl8. Therefore, the piston 202 is lowered from the state shown in the figure to close the main valve 201 of the steam valve 200.

At the same time, by the operation of the high-speed operation electromagnetic valves 521 and 522 described above, the hydraulic oil 26 from the hydraulic pressure generator passes the P and B ports and supplied to the secondary side of the cartridge valves 525 and 526 via the hydraulic pipes pl11 and pl12. As a result, in the cartridge valves 525 and 526, the valving elements 527 and 528 move downwardly from the state shown in the figure against the restoring forces of the reset springs 529 and 530 to thus fully close the A ports.

In the case of the related art (FIG. 4), when the main valve 201 is closed, the hydraulic oil 26 from the hydraulic pressure generator has passed the servo valve 25 to be discharged from the oil-drain port 33 to the oil tank via the A and B ports of the cartridge valves 29 and 30. According to the first embodiment, since the valving elements 527 and 528 of the cartridge valves 525 and 526 fully close the A ports, it is possible to prevent the hydraulic oil 26 from the hydraulic pressure generator from flowing out.

It should be noted that in the descriptions above, the case where the anomaly (abnormality) detection portion of the protection apparatus detects an anomaly during normal drive of the steam turbine has been taken as an example. However, the hydraulic drive apparatus 20 similarly operates even in a case where the high-speed operation electromagnetic valves 521 and 522 are switched from the constant excitation state to a non-excitation state based on a simulation signal at the time of a valve test using a test apparatus (not shown) instead of the case where the anomaly of the steam turbine occurs.

As described above, in the first embodiment, the cartridge valves 525 and 526 are cascaded on the upstream side of the servo valve 25, that is, in the middle of the oil fill tube. Further, at the time an anomaly occurs or during a valve test of the turbo apparatus, the high-speed operation electromagnetic valves 521 and 522 are operated to close the cartridge valves 525 and 526. Therefore, the hydraulic oil 26 supplied to the servo valve 25 can be positively blocked.

As a result, even when an inconvenience occurs in the servo valve, defective components can be easily replaced with non-defective components without stopping the drive. Therefore, the maintenance property of the steam valve apparatus is improved, and reliability of the entire steam turbine including the steam valve apparatus can be additionally improved.

Further, by closing the cartridge valves 525 and 526 and blocking the hydraulic oil 26 to be supplied to the servo valve 25, the servo valve connected on the downstream side of the cartridge valves 525 and 526 can be easily removed and replaced without concerning leakage of the hydraulic oil. Therefore, the maintenance property of the steam valve apparatus is improved. In the replacement, it is desirable for pressure detection taps 531 and 532 provided on the downstream side of the B ports of the cartridge valves 525 and 526 to measure the oil pressure and check that there is no oil pressure. Since the leakage from the cartridge valves 525 and 526 can be checked, an additional safety can be secured.

Furthermore, the high-speed operation electromagnetic valves 521 and 522 and the cartridge valves 525 and 526 are duplexed, and the cartridge valves 525 and 526 are cascaded. Therefore, by merely operating one of the cartridge valves, the hydraulic oil 26 to be supplied to the servo valve 25 can be positively blocked.

It should be noted that it is also possible to provide two electromagnetic valves that are turned ON/OFF in place of the two cartridge valves 525 and 526. However, with the ON/OFF-type electromagnetic valves, a time delay or a miss in cooperation (malfunction) are expected to happen with respect to an anomaly signal from the sequence circuit apparatus. Moreover, since the ON/OFF-type electromagnetic valves structurally have a spool shape that does not include a valve sheet, it is difficult to fully block leakage of the hydraulic oil. Therefore, the ON/OFF-type electromagnetic valves are presumed to be inferior to the cartridge valves 525 and 526 adopted in the first embodiment in reliability.

In addition, in the first embodiment, the high-speed operation electromagnetic valves 521 and 522 are restored (from non-excitation state to excitation state) for the first time when the steam turbine is reset. Therefore, since being operated, the cartridge valves 525 and 526 are in the fully-closed state until being restored. Consequently, from the time the valves are operated to a time the valves are restored, the hydraulic oil 26 from the hydraulic pressure generator is not supplied to the servo valve 25 provided on the downstream side of the cartridge valves 525 and 526.

As a result, during a period before the steam turbine is reset, even when an instruction signal to open a valve is erroneously input to the servo valve 25, the steam valve 200 is not opened. In other words, it can be said that the steam valve apparatus is an extremely safety-conscious steam valve apparatus that also assumes a role as one type of protection apparatus.

Second Embodiment

Figure 2:
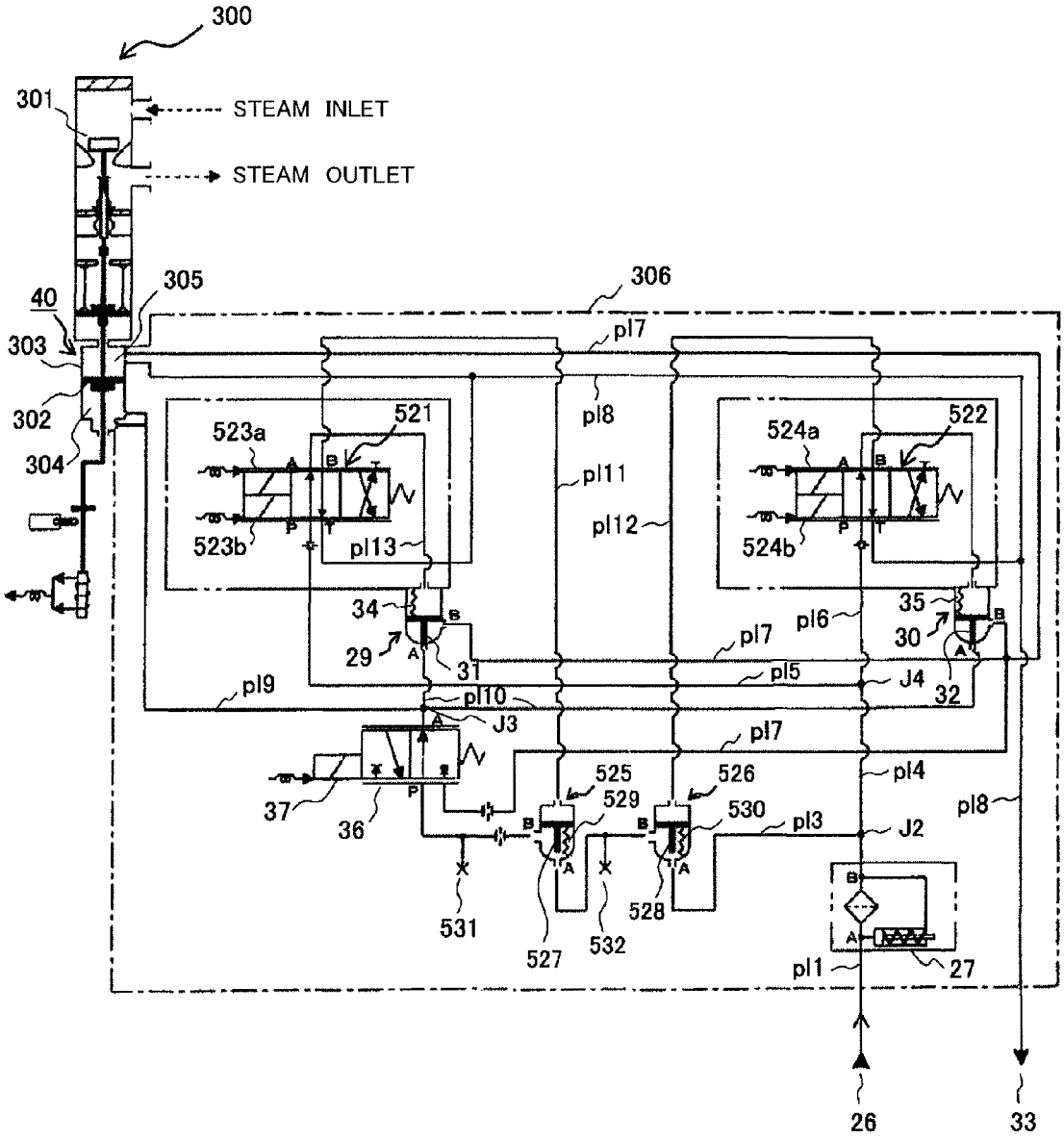
FIG. 2 is a structural diagram of a hydraulic drive apparatus of a steam valve according to a second embodiment.
Figure 3:
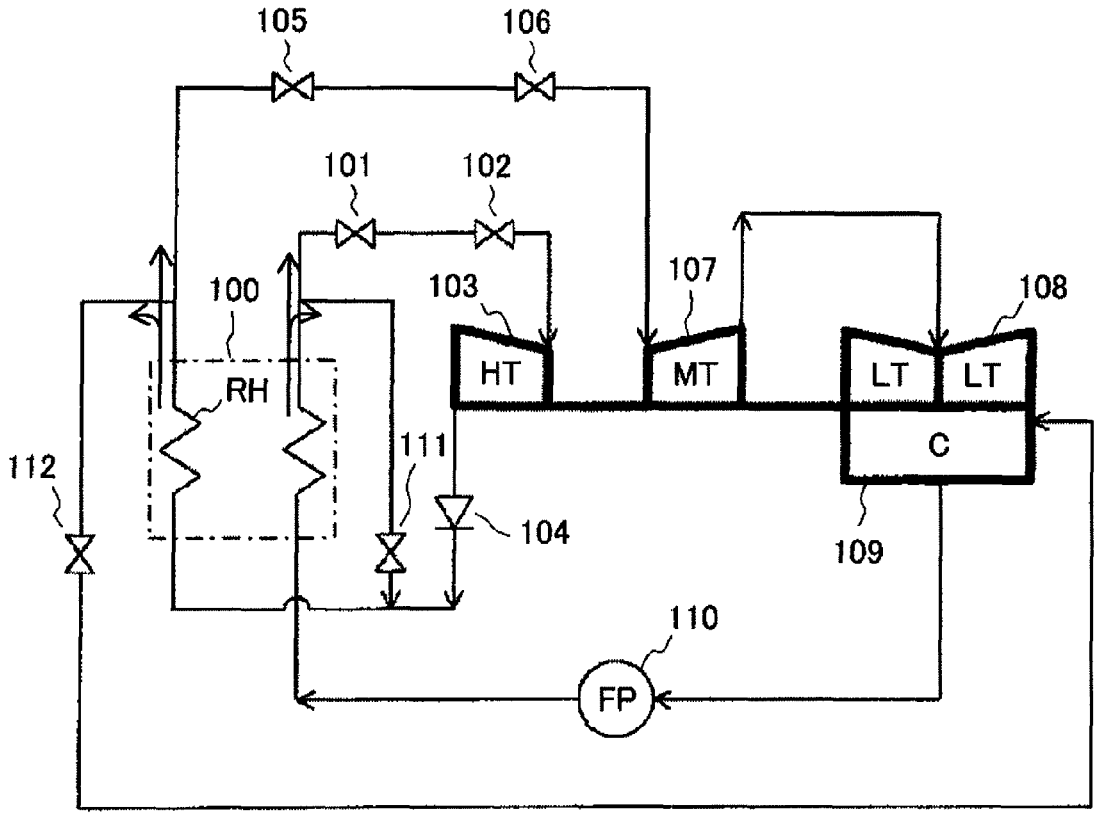
FIG. 3 is a steam system diagram of a typical power generation facility in which a steam turbine is provided.

Hereinafter, a second embodiment of the present invention will be described with reference to FIG. 2. FIG. 2 is a structural diagram of a drive apparatus of a steam valve according to the second embodiment.

Figure 5:
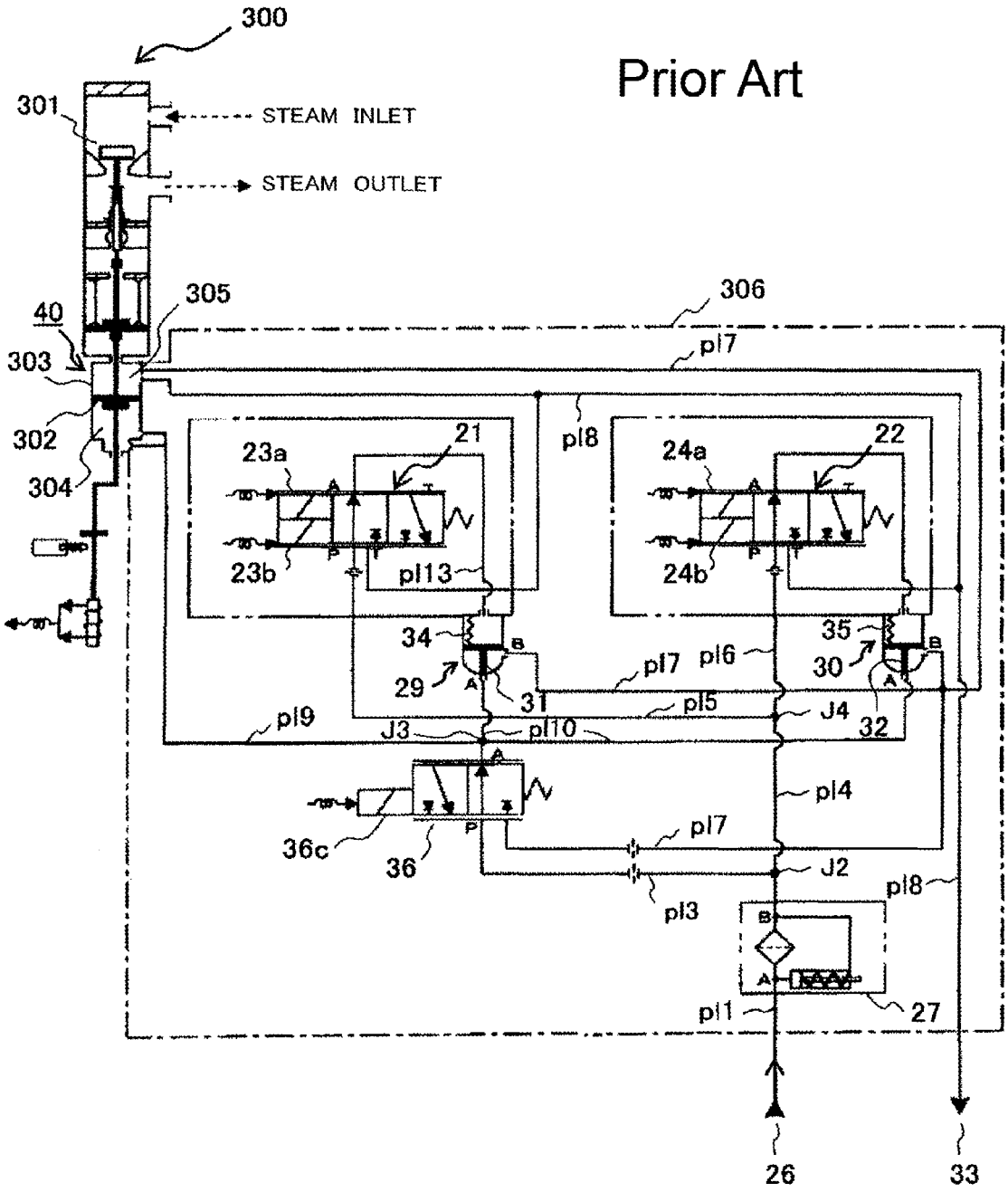
FIG. 5 is a structural diagram of another hydraulic drive apparatus of the steam valve of the related art.

A hydraulic system 306 of the second embodiment is an embodiment for solving the problems of the related art shown in FIG. 5, and many structural components are the same as the hydraulic system 206 of the first embodiment shown in FIG. 1. The hydraulic system 306 is structurally different from the hydraulic system 206 shown in FIG. 1 in that the servo valve 25 is replaced with the test electromagnetic valve 36 (also called third electromagnetic valve). Since other points can be analogically explained from FIGS. 1 to 5, detailed descriptions will be omitted herein, and only a general outline will be described.

In the case of the second embodiment, when the high-speed operation electromagnetic valves 521 and 522 are operated based on an anomaly signal from the anomaly detection portion or a simulation signal at the time a valve test is carried out, the A ports of the cartridge valves 525 and 526 are fully closed. Therefore, the hydraulic oil 26 to be supplied to the test electromagnetic valve 36 from the hydraulic pressure generator (not shown) is blocked.

According to the second embodiment described above, the cartridge valves 525 and 526 are cascaded on the upstream side of the test electromagnetic valve 36, that is, in the middle of the oil fill tube. Further, the high-speed operation electromagnetic valves 521 and 522 are operated by transmitting an anomaly signal or a simulation signal to the steam valve from the sequence circuit (not shown) to thus close the cartridge valves 525 and 526. Therefore, the hydraulic oil 26 to be supplied to the test electromagnetic valve 36 can be positively blocked, and even when an inconvenience occurs in the electromagnetic valve, defective components can be easily replaced with non-defective components without stopping the drive. Therefore, the maintenance property of the steam valve apparatus is improved, and reliability of the entire steam turbine including the steam valve apparatus can be additionally improved.

Further, by blocking the hydraulic oil 26 to be supplied to the test electromagnetic valve 36 by closing the cartridge valves 525 and 526 as described above, the test electromagnetic valve 36 connected on the downstream side of the cartridge valves 525 and 526 can be easily removed and replaced without concerning leakage of the hydraulic oil. Therefore, the maintenance property of the steam valve apparatus is improved. In the replacement, it is desirable for the pressure detection taps 531 and 532 provided on the downstream side of the B ports of the cartridge valves 525 and 526 to measure the oil pressure and check that there is no oil pressure. Since the leakage from the cartridge valves 525 and 526 can be checked, an additional safety can be secured.

Furthermore, the high-speed operation electromagnetic valves 521 and 522 and the cartridge valves 525 and 526 are duplexed, and the cartridge valves 525 and 526 are cascaded. Therefore, by merely operating one of the cartridge valves, the hydraulic oil 26 to be supplied to the test electromagnetic valve 36 can be positively blocked.

In addition, in the second embodiment, the high-speed operation electromagnetic valves 521 and 522 are restored (from non-excitation state to excitation state) for the first time when the steam turbine is reset. Therefore, since being operated, the cartridge valves 525 and 526 are in the fully-closed state until being restored. Consequently, from the time the valves are operated to a time the valves are restored, the hydraulic oil 26 from the hydraulic pressure generator is not supplied to the test electromagnetic valve 36 provided on the downstream side of the cartridge valves 525 and 526.

As a result, during a period before the steam turbine is reset, even when an instruction signal to open a valve is erroneously input to the test electromagnetic valve 36, the steam valve 200 is not opened. In other words, it can be said that the steam valve apparatus is an extremely safety-conscious steam valve apparatus that also assumes a role as one type of protection apparatus.

Moreover, in the drive mechanism of the steam valve apparatus of the related art, after an anomaly occurs in the steam turbine and the high-speed operation electromagnetic valves 21 and 22 are operated and put to a non-excitation state, the oil to the piston 302 that has been supplied via the test electromagnetic valve 36 until then is discharged from the oil-drain port 33 via the A ports of the cartridge valves 29 and 30 without remaining in the lower cylinder 304. According to the second embodiment, by closing the cartridge valves 525 and 526 in an interlocking manner with the operation of the high-speed operation electromagnetic valves 521 and 522, the hydraulic oil 26 is blocked. Therefore, the hydraulic oil 26 can be prevented from being discharged from the oil-drain port 33 irrespective of whether the test electromagnetic valve 36 is opened or closed.

As described above, according to the embodiments above, the maintenance property of the steam valve apparatus can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam valve apparatus, comprising:

a steam valve passing or blocking a steam to a turbo machine;

a piston operated by a hydraulic liquid to open or close the steam valve;

a hydraulic cylinder including an internal space sectioned into a first chamber and a second chamber by the piston, the first chamber being on an open side of the steam valve, and the second chamber being on a close side of the steam valve;

a hydraulic control valve to control supply of the hydraulic liquid to the first chamber;

a first passage to supply the hydraulic liquid to the hydraulic control valve;

a second passage connecting the first chamber and the second chamber;

a third passage to drain the hydraulic liquid from the second chamber;

an electromagnetic valve switched between a first state and a second state based on an input of a signal;

a first cartridge valve opening the first passage when the electromagnetic valve is in the first state, and closing the first passage when the electromagnetic valve is in the second state; and a second cartridge valve closing the second passage when the electromagnetic valve is in the first state, and opening the second passage to drain the hydraulic liquid in the first chamber via the second passage, the second chamber, and the third passage when the electromagnetic valve is in the second state, wherein the electromagnetic valve includes:

a first port to which the hydraulic liquid is supplied;

a second port from which the hydraulic liquid is drained;

a third port connected to a control port of the first cartridge valve; and a fourth port connected to a control port of the second cartridge valve, the first and fourth ports are connected and the second and third ports are connected when the electromagnetic valve is in the first state, and the first and third ports are connected and the second and fourth ports are connected when the electromagnetic valve is in the second state.

2. The steam valve apparatus according to claim 1, wherein the hydraulic liquid is drained from the control port of the first cartridge valve to open the first passage when the electromagnetic valve is in the first state, and the hydraulic liquid is supplied to the control port of the first cartridge valve to close the first passage when the electromagnetic valve is in the second state.

3. The steam valve apparatus according to claim 2, wherein the first cartridge valve includes:

a valving element opening or closing the first passage; and an elastic body applying a force to the valving element so as to open the first passage.

4. The steam valve apparatus according to claim 1, wherein the hydraulic liquid is supplied to the control port of the second cartridge valve to close the second passage when the electromagnetic valve is in the first state, and the hydraulic liquid is drained from the control port of the second cartridge valve to open the second passage when the electromagnetic valve is in the second state.

5. The steam valve apparatus according to claim 4, wherein the second cartridge valve includes:

a valving element opening or closing the second passage; and an elastic body applying a force to the valving element so as to close the second passage.

6. The steam valve apparatus according to claim 1, wherein the signal is an abnormality signal or a test signal, the abnormality signal indicating that the turbo machine is in an abnormality state, and the test signal is for an operation test of the steam valve, and the electromagnetic valve switches from the first state to the second state by the input of the signal.

7. The steam valve apparatus according to claim 1, wherein the electromagnetic valve in the first state is in an excitation state, and the electromagnetic valve in the second state is in a non-excitation state.

8. The steam valve apparatus according to claim 1, further comprising:

a second electromagnetic valve switched between the first state and the second state;

a third cartridge valve opening the first passage when the second electromagnetic valve is in the first state, and closing the first passage when the second electromagnetic valve is in the second state; and a fourth cartridge valve closing the second passage when the second electromagnetic valve is in the first state, and opening the second passage when the second electromagnetic valve is in the second state.

9. The steam valve apparatus according to claim 8, wherein the first and third cartridge valves are cascaded.

10. The steam valve apparatus according to claim 8, further comprising:

first and second pressure detection taps respectively provided in the first and third cartridge valves.

11. The steam valve apparatus according to claim 1, wherein the hydraulic control valve is one of a servo valve and a third electromagnetic valve.

12. A steam valve apparatus, comprising:

a steam valve passing or blocking a steam to a turbo machine;

a piston operated by a hydraulic liquid to open or close the steam valve;

a hydraulic cylinder including an internal space sectioned into a first chamber and a second chamber by the piston, the first chamber being on an open side of the steam valve, and the second chamber being on a close side of the steam valve;

a hydraulic control valve to control supply of the hydraulic liquid to the first chamber;

a first passage to supply the hydraulic liquid to the hydraulic control valve;

a second passage connecting the first chamber and the second chamber;

a third passage to drain the hydraulic liquid from the second chamber;

an electromagnetic valve switched between a first state and a second state based on an input of a signal;

a first cartridge valve opening the first passage when the electromagnetic valve is in the first state, and closing the first passage when the electromagnetic valve is in the second state; and a second cartridge valve closing the second passage when the electromagnetic valve is in the first state, and opening the second passage to drain the hydraulic liquid in the first chamber via the second passage, the second chamber, and the third passage when the electromagnetic valve is in the second state, wherein the hydraulic liquid is drained from a control port of the first cartridge valve to open the first passage when the electromagnetic valve is in the first state, and the hydraulic liquid is supplied to the control port of the first cartridge valve to close the first passage when the electromagnetic valve is in the second state.

13. The steam valve apparatus according to claim 12, wherein the first cartridge valve includes:

a valving element opening or closing the first passage; and an elastic body applying a force to the valving element so as to open the first passage.

14. A steam valve apparatus, comprising:

a steam valve passing or blocking a steam to a turbo machine;

a piston operated by a hydraulic liquid to open or close the steam valve;

a hydraulic cylinder including an internal space sectioned into a first chamber and a second chamber by the piston, the first chamber being on an open side of the steam valve, and the second chamber being on a close side of the steam valve;

a hydraulic control valve to control supply of the hydraulic liquid to the first chamber;

a first passage to supply the hydraulic liquid to the hydraulic control valve;

a second passage connecting the first chamber and the second chamber;

a third passage to drain the hydraulic liquid from the second chamber;

an electromagnetic valve switched between a first state and a second state based on an input of a signal;

a first cartridge valve opening the first passage when the electromagnetic valve is in the first state, and closing the first passage when the electromagnetic valve is in the second state;

a second cartridge valve closing the second passage when the electromagnetic valve is in the first state, and opening the second passage to drain the hydraulic liquid in the first chamber via the second passage, the second chamber, and the third passage when the electromagnetic valve is in the second state;

a second electromagnetic valve switched between the first state and the second state;

a third cartridge valve opening the first passage when the second electromagnetic valve is in the first state, and closing the first passage when the second electromagnetic valve is in the second state; and a fourth cartridge valve closing the second passage when the second electromagnetic valve is in the first state, and opening the second passage when the second electromagnetic valve is in the second state.

15. The steam valve apparatus according to claim 14, wherein the first and third cartridge valves are cascaded.

16. The steam valve apparatus according to claim 14, further comprising:

first and second pressure detection taps respectively provided in the first and third cartridge valves.

* * * * *